US006511211B1

(12) United States Patent
Karambelas

(10) Patent No.: US 6,511,211 B1
(45) Date of Patent: Jan. 28, 2003

(54) RETAINER FOR A LIGHT FIXTURE

(75) Inventor: Demetrios Karambelas, Philadelphia, PA (US)

(73) Assignee: Angelo Brother's Company, Philadelphia, PA (US)

( * ) Notice: Subject to any disclaimer, the term of this patent is extended or adjusted under 35 U.S.C. 154(b) by 0 days.

(21) Appl. No.: 09/658,122

(22) Filed: Sep. 8, 2000

(51) Int. Cl.[7] ..... F21V 3/00

(52) U.S. Cl. ..... 362/311; 362/351; 362/431; 362/414

(58) Field of Search ..... 362/311, 351, 362/431, 368, 433, 257, 285, 289, 248, 147, 410, 414

(56) References Cited

U.S. PATENT DOCUMENTS

| | | | | | |
|---|---|---|---|---|---|
| 3,873,221 | A | * | 3/1975 | Greenfield | 403/189 |
| 4,088,293 | A | | 5/1978 | Delmore | 248/500 |
| 4,356,537 | A | | 10/1982 | Stahlhut et al. | 362/148 |
| 4,431,151 | A | | 2/1984 | Schonasky | 248/27.1 |
| 4,572,698 | A | * | 2/1986 | Rauch | 403/356 |
| 4,593,344 | A | | 6/1986 | Basile | 362/226 |
| 5,019,753 | A | * | 5/1991 | Strauss | 315/362 |
| 5,272,610 | A | | 12/1993 | Namenye et al. | 362/351 |
| 5,791,764 | A | | 8/1998 | Jaksich | 362/222 |
| 6,017,071 | A | * | 1/2000 | Morghen | 294/94 |

FOREIGN PATENT DOCUMENTS

| | | |
|---|---|---|
| EP | 03789751 | * 12/1989 |

* cited by examiner

*Primary Examiner*—Sandra O'Shea
*Assistant Examiner*—Ali Alavi
(74) *Attorney, Agent, or Firm*—Woodcock Washburn LLP

(57) ABSTRACT

The present invention is an apparatus for maintaining a light fixture diffuser in contact with a light fixture base by means of a retainer. In a light fixture, a threaded rod is used to connect the diffuser to the base. A simple retainer is used to maintain the threaded rod to the base of the light fixture or to retain releasable connectors on the rod, where the releasable connectors are used to attach the rod to the base of the light fixture.

16 Claims, 1 Drawing Sheet

RETAINER FOR A LIGHT FIXTURE

FIELD OF THE INVENTION

The present invention relates generally to a retainer for a light fixture, and more particularly to a retainer that secures a diffuser of a light fixture preventing it from inadvertently disengaging from a base of the light fixture.

BACKGROUND OF THE INVENTION

Light fixtures typically use a threaded rod to attach a diffuser to a base of a light fixture. A base end of the threaded rod is usually connected to the base of the light fixture by means such as a nut and washers. At a diffuser end of the rod, another releasable connector is used to maintain the diffuser in contact with the base.

Light fixture diffusers are routinely removed from the diffuser end of the rod for cleaning and bulb replacement. Diffuser removal requires the physical removal of the releasable connector on the diffuser end of the rod, however, unthreading this releasable connector often causes rotation of the rod which also loosens the releasable connector at the base end of the base. Over time, the releasable connector at the base end of the rod disengages from the rod, causing the diffuser to crash to the floor. Accordingly, there is a need to secure the releasable connector at the base end of the rod to the rod, thus preventing the disengagement of this releasable connector from the base end of the rod and preventing the diffuser from inadvertently separating from the base and falling to the floor.

SUMMARY OF THE INVENTION

The present invention is directed to an apparatus and method that solves the long felt need for preventing the inadvertent separation of a diffuser from a base of a light fixture. In one aspect of the present invention, a retainer is attached to a base end of a rod that is used to maintain the diffuser in contact with the base. The rod is connected to the base by a releasable connector, and the retainer secures the releasable connector to the rod.

In another aspect of the present invention, the retainer is a cotter pin inserted through the rod preventing the releasable connector from disengaging the rod at the base end of the rod.

In another aspect of the present invention, the retainer is a pin or screw inserted through the rod, where the pin or screw prevents the releasable connector from disengaging the rod at the base end of the rod.

In yet another aspect of the present invention, the retainer is a washer or disc-shaped device attached to the base end of the rod, preventing the releasable connector from disengaging the rod at the base end of the rod.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
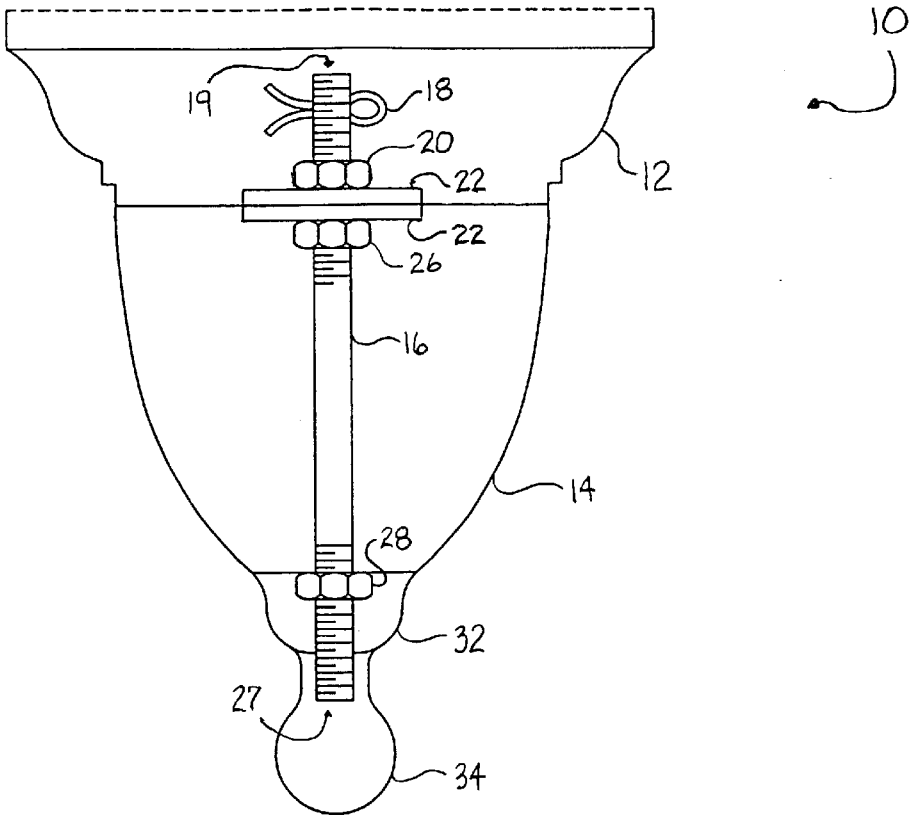
FIG. 1 illustrates a light fixture with a retainer according to one embodiment of the present invention.

Referring now to the drawings, wherein like numerals indicate like elements, there is shown in FIG. 1 an illustration of a light fixture 10 comprising a retainer 18 according to one embodiment of the present invention. The light fixture 10 includes a base 12, a diffuser 14, a threaded rod 16, and the retainer 18. The rod 16 maintains the diffuser 14 in contact with the base 12 through releasable connection of the rod 16 with the base 12 and the diffuser 14.

In FIG. 1, a base end 19 of the rod 16 is inserted through a hole (not shown) in the base 12. Washers 22 maintain contact with the base 12 around the hole (not shown) through which the rod 16 is inserted. A first releasable connector 20 and a second releasable connector 26 are tightened against the washers 22 to connect the rod 16 to the base 12. The releasable connectors 20,26 are typically nuts or internally threaded discs adaptable to the threads of the rod 16.

A diffuser end 27 of the rod 16 extends through a hole (not shown) in a bottom of the diffuser 14. The diffuser 14 is held in contact with the base 12 by a third releasable connector 28 threaded onto the rod 16.

A decorative vase cup 32 is mounted against the bottom of the diffuser 14 with the diffuser end 27 of the rod 16 extending through a hole (not shown) contained in a bottom of the vase cup 32. The decorative vase cup 32 covers the third releasable connector 28. A decorative finial 34 maintains the decorative vase cup 32 against the diffuser 14. The decorative finial 34 can be internally threaded and is tightened on the diffuser end 27 of the rod 16 against the decorative vase cup 32.

Removal of the diffuser 14 for bulb (not shown) replacement or diffuser 14 cleaning requires the removal of the decorative finial 34, the decorative vase cup 32 and the third releasable connector 28 from the diffuser end 27 of the rod 16. The tightening and untightening of the finial 34 and the third releasable connector 28 on the rod 16 often causes rotational movement in the rod 16. Over time, the rotational movement of the rod 16 loosens the first releasable connector 20, eventually causing the first releasable connector 20 to disengage from the base end 19 of the rod 16, resulting in the diffuser 14 falling to the floor.

Disengagement of the first releasable connector 20 from the base end 19 of the rod 16 is prevented by a retainer 18. In FIG. 1, the retainer 18 is a cotter pin inserted through the rod 16. The retainer 18 prevents the first releasable connector 20 from threadably disengaging the base end 19 of the rod 16, thereby securing the first releasable connector 20 to the rod 16. Although FIG. 1 illustrates the retainer 18 inserted through the rod 16 near the base end 19, it is to be understood that a multitude of variations can exist for the insertion of the retainer 18 through the rod 16.

Figure 2:
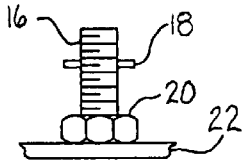
FIG. 2 illustrates a retainer connected to a rod of a light fixture according to a second embodiment of the present invention.

FIG. 2 illustrates retainer 18 according to a second embodiment of the present invention, where the retainer 18 is a pin inserted through the rod 16. The retainer 18 prevents the first releasable connector 20 from threadably disengaging the base end 19 of the rod 16.

Figure 3:
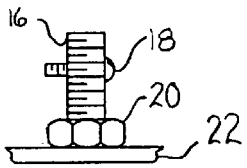
FIG. 3 illustrates a retainer connected to a rod of a light fixture according to a third embodiment of the present invention.

FIG. 3 illustrates retainer 18 according to a third embodiment of the present invention, where the retainer 18 is a screw inserted through the rod 16 to secure the first releasable connector 20 to the rod 16.

Figure 4:
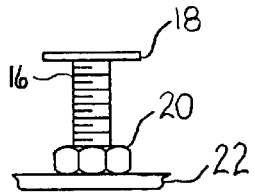
FIG. 4 illustrates a retainer connected to a rod of a light fixture according to a fourth embodiment of the present invention.

FIG. 4 illustrates retainer 18 according to a fourth embodiment of the present invention, where the retainer 18 is a washer or other disc-shaped device attached to the base end 19 of the rod 16, preventing the first releasable connector 20 from disengaging the base end 19 of the rod 16.

Although FIGS. 1 through 4 illustrate four retainer variations, it is to be understood that any device or method preventing the first, or any other, releasable connector from becoming disengaged from the base end 19 of the rod 16 is within the scope of the present invention. This includes simply damaging or crimping the threads at the base end 19 of the rod 16 to prevent the threadable removal of any releasable connector from the base end 19 of the rod 16.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A light fixture with retainer, comprising:

a base;

a diffuser;

a rod maintaining the diffuser in contact with the base, the rod connected to the base by a releasable connector; and a retainer attached to the rod, the retainer securing the releasable connector to the rod.

2. A ceiling mounted light fixture, comprising:

a base attached to a ceiling;

a diffuser;

a rod attaching the base and to the diffuser;

a releasable connector attaching the rod to the base; and a retainer attached to the rod, the retainer securing the releasable connector to the rod, preventing the diffuser from separating from the light fixture and falling to a floor.

3. A method for maintaining a diffuser of a light fixture in contact with a base of a light fixture, comprising:

connecting the diffuser to the base with a rod;

connecting the rod to the base with a releasable connector; and securing the releasable connector to the rod.

4. A light fixture with retainer, comprising:

a base;

a diffuser;

a rod maintaining the diffuser in contact with the base, the rod connected to the base by a releasable connector; and a retainer attached to the rod, the retainer securing the releasable connector to the rod, wherein the retainer is a cotter pin inserted through the rod.

5. The light fixture of claim 1, wherein the retainer is a pin inserted through the rod.

6. The light fixture of claim 1, wherein the retainer is a screw inserted through the rod.

7. The light fixture of claim 1, wherein the retainer is connected to an end of the rod.

8. A retainer for a light fixture, the retainer preventing the release of a diffuser from a base of the light fixture.

9. The retainer of claim 8, wherein the retainer is attached to a rod, the rod maintains the diffuser in contact with the base, and the rod is connected to the base by a releasable connector.

10. The retainer of claim 9, wherein the retainer secures the releasable connector to the rod.

11. A retainer for a light fixture, the retainer preventing the release of a diffuser from a base of the light fixture, wherein the retainer is attached to a rod, the rod maintains the diffuser in contact with the base, and the rod is connected to the base by a releasable connector, wherein the retainer secures the releasable connector to the rod, wherein the retainer is a cotter pin inserted through the rod.

12. The retainer of claim 10, wherein the retainer is a pin inserted through the rod.

13. The retainer of claim 10, wherein the retainer is a screw inserted through the rod.

14. The retainer of claim 10, wherein the retainer is connected to an end of the rod.

15. A light fixture, comprising:

a base;

a diffuser;

a rod maintaining the diffuser in contact with the base, the rod connected to the base by a releasable connector; and a retainer attached to the rod, the retainer securing the releasable connector to the rod, preventing the diffuser from separating from the light fixture and falling to the floor.

16. A light fixture, comprising:

a base;

a diffuser;

a rod attached to the diffuser and to the base;

a releasable connector attaching the rod to the base; and a retainer preventing release of the releasable connector from the rod.

* * * * *